US005224660A

United States Patent [19]

Stahlecker

[11] Patent Number: 5,224,660

[45] Date of Patent: Jul. 6, 1993

[54] SPINNING MACHINE HAVING A SPOOL AND PACKAGE CHANGING DEVICE

[75] Inventor: Fritz Stahlecker, Josef-Neidhart-Strasse 18, 7345 Bad Überkingen, Fed. Rep. of Germany

[73] Assignees: Fritz Stahlecker; Hans Stahlecker, both of Fed. Rep. of Germany; a part interest

[21] Appl. No.: 952,792

[22] Filed: Sep. 28, 1992

Related U.S. Application Data

[63] Continuation of Ser. No. 693,083, Apr. 29, 1991, abandoned, which is a continuation-in-part of Ser. No. 390,880, Aug. 8, 1989, abandoned.

[30] Foreign Application Priority Data

Aug. 11, 1988 [DE] Fed. Rep. of Germany ..... 3827233
Mar. 15, 1989 [DE] Fed. Rep. of Germany ..... 3908462

[51] Int. Cl.[5] ..... B65H 67/04; B65H 54/26
[52] U.S. Cl. ..... 242/35.5 A; 242/35.5 R
[58] Field of Search ..... 242/35.5 A, 35.5 R, 242/35.6 R; 57/266, 268, 269, 270

[56] References Cited

U.S. PATENT DOCUMENTS

| | | | |
|---|---|---|---|
| 3,077,311 | 2/1963 | Furst | 242/35.5 R |
| 4,066,218 | 1/1978 | Kamp | 242/35.5 A |
| 4,125,990 | 11/1978 | Stahlecker et al. | 242/35.5 A X |
| 4,139,108 | 2/1979 | Kamp et al. | 242/35.5 A X |
| 4,145,868 | 3/1979 | Morita et al. | 57/268 |
| 4,154,411 | 5/1979 | Kamp et al. | 242/35.5 A X |
| 4,155,513 | 5/1979 | Maassen | 242/35.5 A |
| 4,535,944 | 8/1985 | Nakahara et al. | 242/35.5 A |
| 4,610,405 | 9/1986 | Noshi | 242/35.5 A |
| 4,638,956 | 1/1987 | Wey | 242/35.5 A |
| 4,688,735 | 8/1987 | Shinji et al. | 242/35.5 A |
| 4,702,427 | 10/1987 | Raasch | 242/35.5 A |

FOREIGN PATENT DOCUMENTS

| | | | |
|---|---|---|---|
| 2422746 | 11/1979 | France . | |
| 69366 | 4/1984 | Japan | 242/35.5 R |
| 720202 | 12/1954 | United Kingdom | 242/35.6 R |
| 2006841 | 5/1979 | United Kingdom . | |

*Primary Examiner*—Stanley N. Gilreath
*Attorney, Agent, or Firm*—Evenson, McKeown, Edwards & Lenahan

[57] ABSTRACT

In the case of a spinning machine having a plurality of spinning units arranged next to one another and having movable spool and package changing devices, two spool and package changing devices are provided for one side of the machine which can each be moved over half the machine length and to each of which a separate tube loading station is assigned.

13 Claims, 4 Drawing Sheets

31
32
18'
19
LOCK
36
18A
30
35
34
29
33
15
21
22
2
5
23
1
24
16
25
6
Z
7
26
12
27
28
4
8
11

SPINNING MACHINE HAVING A SPOOL AND PACKAGE CHANGING DEVICE

This is a continuation of application Ser. No. 07/693,083, filed Apr. 29, 1991, now abandoned, which is a continuation -in-part of U.S. patent application Ser. No. 07/390,880, filed Aug. 8, 1989, now abandoned.

BACKGROUND AND SUMMARY OF THE INVENTION

The invention relates to a spinning machine having a plurality of spinning units arranged next to one another, which are each equipped with wind-up arrangements for the winding-up of cross-wound packages, and having spool and package changing devices which can be moved between the spinning units and a tube changing station and which each carry along a magazine for empty spools and which contain devices for the ejecting of a cross-wound package from a wind-up arrangement and for inserting an empty tube into the wind-up arrangement.

In the case of a spinning machine having a plurality of spinning units arranged next to one another on both sides of the machine, it is known from German Published Unexamined Patent Application (DE-A) 27 37 645, corresponding to U.S. Pat. No. 4,155,513, to equip each side of the machine with a movable device for changing spools and packages which is assigned to only this side of the machine. A common tube changing station is assigned to these two independently movable devices for changing spools and packages, which is arranged at one machine end and fills the magazines of the devices for changing spools and packages with tubes. If very high delivery speeds are used and/or relatively small cross-wound packages are produced, there is the risk that the capacity of these devices for changing spools and packages is not sufficient so that idle times will occur at the machine.

It is also known (Neues aus der Technik, Year 1976, No. 6, Dec. 1, 1976, Page 4) to provide two or several identical movable servicing devices on one side of a spinning machine which are not assigned to any specific number of spinning units. In the case of this construction, it must be expected that the servicing devices meet at arbitrary points of the machine, so that arrangements are mounted at the servicing devices by means of which a mutual pushing-off of the servicing devices takes place as soon as they run against one another.

An object of the invention is to develop a spinning machine with spool and package changing devices of the initially mentioned type in such a manner that the spool and package changing devices are not overstressed even at high spool or package speeds and/or by small spool or packages sizes.

This object is achieved in that two spool and package changing devices are provided for one side of the machine which can be moved over half the length of the machine and to each of which a separate tube loading station is assigned.

This construction provides two spool and package changing devices which are completely independent of one another, each servicing one half of the machine and to which separate loading devices are also assigned. This type of a construction is particularly suitable for a spinning machine in which the spinning units are arranged only on one side of the machine. This construction results in the additional advantage that the two spool and package changing devices and the tube loading stations may have a practically identical construction, so that the expenditures remain acceptable.

In an expedient development of the invention, it is provided that the tube loading stations are, in each case, arranged at the machine end. In this case, it is also advantageous for the tube loading stations to be arranged spatially above the magazine of the respective spool and package changing device. As a result, it becomes possible to move the magazines of the spool and package changing devices directly under the tube loading stations and to take over the empty tubes.

In a further development of preferred embodiments of the invention, it is provided that the tube loading stations are constructed as devices which can be moved away from the machine. In another embodiment, it is provided that the tube loading stations have a tube magazine which can be separated from a delivery device mounted stationarily on the machine. In both cases, it is possible to load the tube magazines of the tube loading stations at a point which is separate from the machine, in which case, this may be carried out by means of a loading device which is intended for a plurality of tube loading stations of this type.

Other objects, advantages and novel features of the present invention will become apparent from the following detailed description of the invention when considered in conjunction with the accompanying drawings.

DETAILED DESCRIPTION OF THE DRAWINGS

Figure 1:
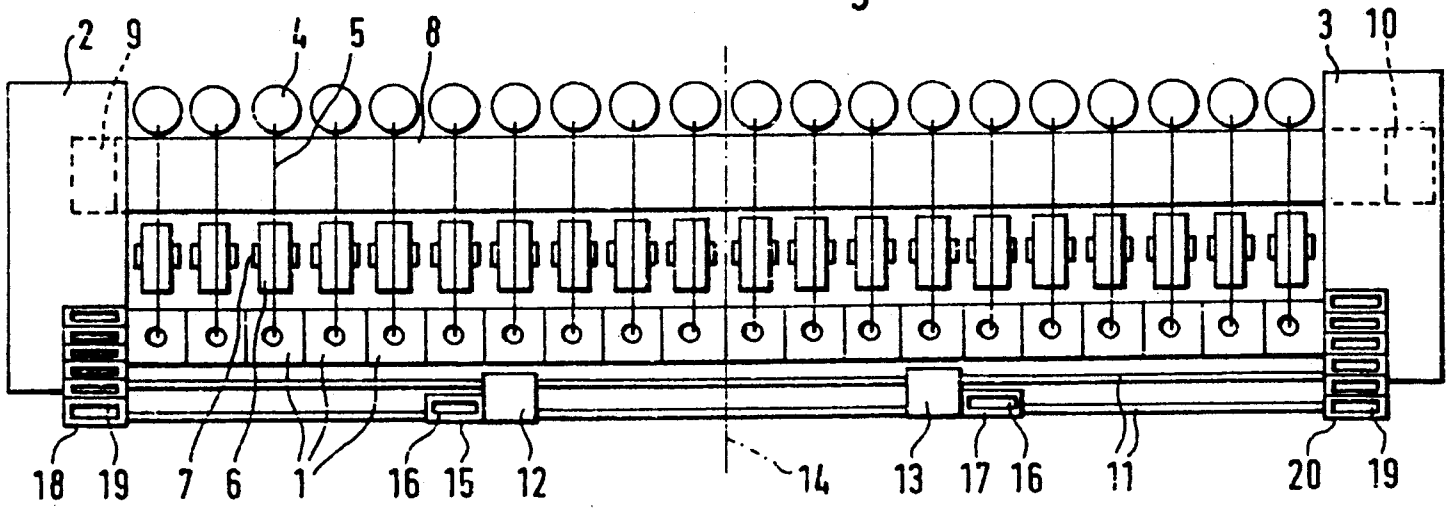
FIG. 1 is a top view of a schematically shown spinning machine constructed according to a preferred embodiment of the invention which is equipped with spinning units only on one side and which, on this machine side, has two independent spool and package changing devices with separate tube loading stations.

The shown spinning machine is a pneumatic false-twist spinning machine. It is equipped with a plurality of spinning units 1 arranged next to one another in a row on only one side of the machine. The row of spinning units 1 is in each case, delimited at the machine ends by a headstock 2, 3, in which drives and gears and deflecting devices for drives are housed. One headstock 2 is outlined in FIG. 2 only in its contour by means of a dash-dotted line.

A can 4 is set up for each spinning unit 1 on the rear side of the machine, from which the sliver 5 to be spun is taken and is fed to the spinning unit 1. Via deflecting guides 21, 22, the sliver 5 moves to a drafting unit 23, which is followed by a pneumatic false-twist spinning device 24 This false-twist spinning device 24 is followed by a pair of withdrawal rollers 25, behind which a wind-up device is connected, of which one wind-up roller 26 is shown. The spun yarn is wound to a cross-wound package 6 on a spool or tube 7. The spool 7 is held in a spool frame in a manner not shown in detail. In particular, it may be provided in this type of a machine that two slivers are spun at adjacent spinning units and, in the process, are only prestrengthened. The two prestrengthened yarn components are then fed to a common wind-up device and are jointly wound onto a spool, which will be used as a feeding package for a twisting operation. In this case, high delivery speeds are reached, on the one hand, while, on the other hand, relatively small package sizes are spun. As a result, spools and packages have to be changed relatively frequently.

The changing of spools and packages is carried out by two fully automatic spool and package changing devices 12, 13 which can be moved back and forth in front of the spinning units 1 and which, when required, are applied to a spinning unit 1. The spool and package changing devices 12, 13 are designed such that they service precisely one half of the machine; i.e., they do not move beyond the center 14 of the machine. For this reason, no special safety precautions have to be provided at the two spool and package changing devices in order to prevent that they strike against one another.

The spool and package changing devices 12, 13, can be moved on tracks 11, by means of running wheels 28 which are placed over the whole length of the machine in front of the spinning units 1 and which are used by both spool and package changing devices 12, 13. The spool and package changing devices 12, 13 are equipped with their own, not shown travelling mechanisms.

Each spool and package changing device 12, 13 carries along a tube magazine 15, 17, in which a certain number of empty tubes 16 are contained. In a known manner, the spool and package changing devices 12, 13 are equipped with devices by means of which they can eject the full cross-wound packages 6 from the respective wind-up device. The ejected full packages 6 slide to a conveyer belt 8 extending in longitudinal direction of the machine by way of a sliding surface 27 and are guided through a headstock 2, 3 in the area of a recess, so that the full packages 6 may be taken off at the machine end. As shown in FIG. 1, the conveyer belt 8 is guided by means of a deflecting pulley 9 and a driving roller 10.

In addition, the spool and package changing devices are equipped with devices, which are also known and by means of which they take an empty spool tube 16 from their magazine 15 or 17 and place it in the not shown spool frames of the wind-up device of the corresponding spinning unit 1. These devices are known on the basis of the state of the art, exemplified by U.S. Pat. No. 4,125,990 and do not have to be explained here in detail.

A tube loading station 18, 20 is assigned to each of the two spool and package changing devices 12, 13 in the area of the machine ends, i.e., at the headstocks 2, 3. The tube loading stations 18, 20 are equipped with several vertical compartments 31, 32 in which empty tubes 19 are arranged so that they are aligned in the manner required by the magazines 15, 17 of the spool and package changing devices 12, 13; i.e., the empty spool tubes extend in longitudinal direction of the machine. Below the vertical compartments 31, 32, a conveyer belt 33 is arranged which is guided around a driving roller 34 and a deflection pulley 35 and the delivery direction of which extends transversely with respect to the longitudinal direction of the machine. The conveyer belt 33, by means of transverse webs 36, is subdivided into compartments, the width of which corresponds to approximately the width of an empty spool tube 19. The conveyer belt 33 of the tube loading station 18, 20 conveys the empty spool tubes 19, by way of an ejection opening 30 directly into the magazine 15 of the spool or package changing devices 12, 13. As shown particularly in FIG. 2, the tube loading stations 18, 20 are arranged in an elevated position above the respective magazine 15, 17 of the spool and package changing devices 12, 13, so that these can be moved directly under the ejection opening 30. Conveyor belt 33 is controlled using known techniques, such as disclosed in the above-mentioned U.S. Pat. No. 4,125,990.

Figure 2:
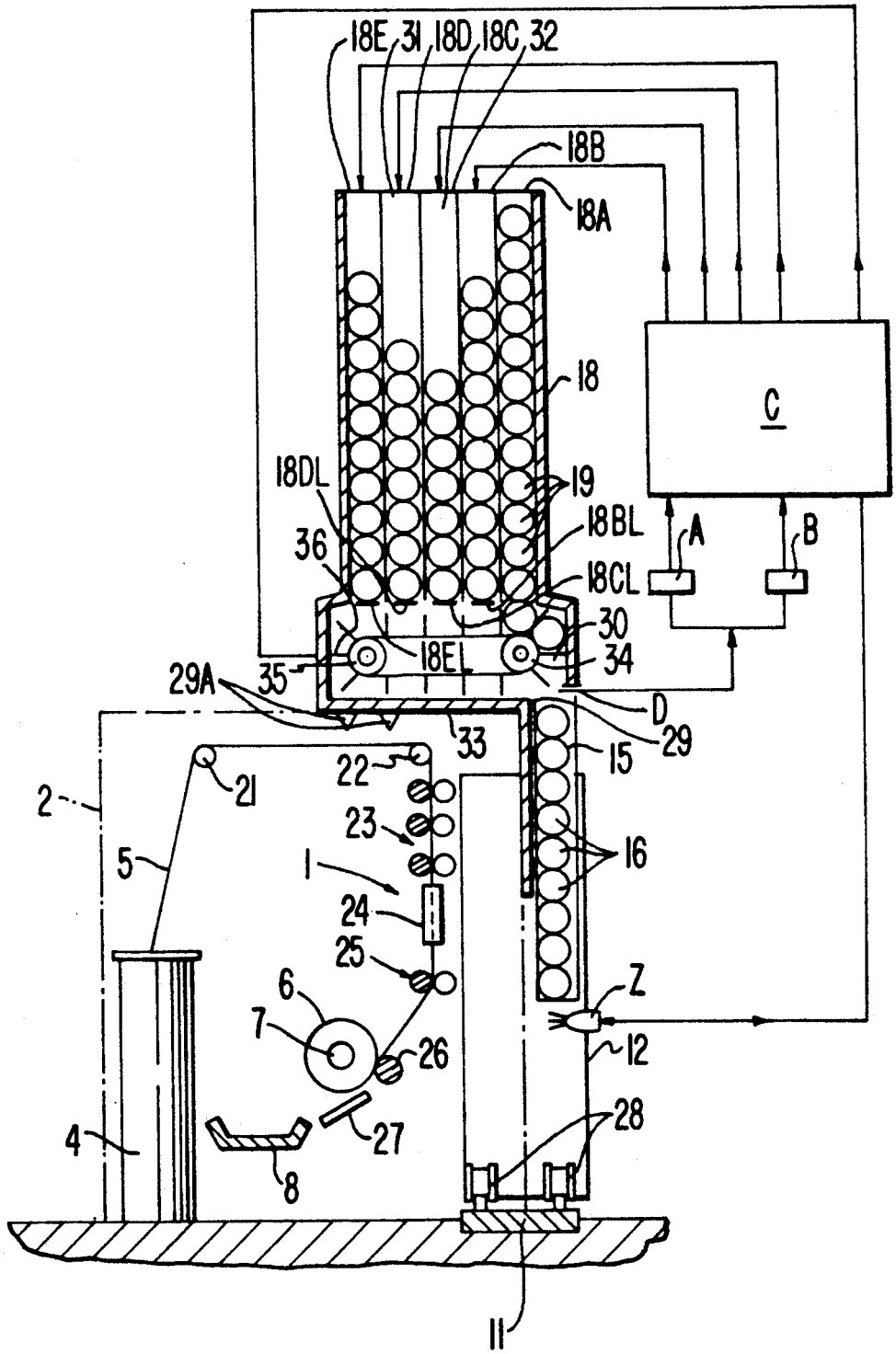
FIG. 2 is a partially opened-up lateral view of the spinning machine according to FIG. 1.

FIG. 2 of the present application schematically depicts a preferred embodiment of a system for controlling conveyor belt 33, including a controller C, a detector D arranged at the outlet of the magazine supply for detecting empty tubes falling past the same, and counters A and B. See U.S. Pat. No. 4,125,990, column 12, line 24 et seq. For example, this system could be operated utilizing the arrangement disclosed in the present application and based upon the known prior art arrangements exemplified by the U.S. patents incorporated in the specification as follows:

The servicing apparatus 12 stores how many doffing operations it has carried out before it returns to the magazine. Correspondingly, it stores the information as to how many empty tubes are absent and must be filled into its magazine. A counter Z is schematically depicted in FIG. 2 for sensing the filled condition of a magazine on the servicing apparatus 12. In the take-over filling position, the servicing apparatus, by means of a line, is connected with the control C of the drive of the belt 33 so that the control C receives the information as to how many empty spool tubes must be charged. The belt 33 is switched on until the sufficient number of spool tubes has been charged. For this purpose, a detector D is arranged at the outlet of the magazine, recognizes the spool tubes falling past it and emits a corresponding signal to a counter B. In the control system, the counted number of fed spool tubes is compared with the required number so that, when the required number is reached, the drive of the belt 33 is switched off. The control system C has stored information as to how many empty spool tubes are present in the individual compartments of the full magazine. By means of a second counter A, the number of all spool tubes is counted which is delivered from the belt 33 to the servicing apparatus 12 which also receives the signal of the detector. When the control system determines that the first compartment 18A no longer contains any empty spool tubes, a lock 18BL of the second compartment 18B is released so that then its spool tubes can be received and taken along by the belt 33. When this second compartment 18B is empty, which is also determined by the counter A, the control system switches over to the next compartment 18C, and subsequently 18D, and 18E, with corresponding locks 18CL, 18DL and 18EL.

It may, however, also be provided that no locks exist underneath the compartments of the magazine so that all pockets of the belt 33 disposed underneath the compartments are filled with empty spool tubes. This would correspond to the embodiment according to FIGS. 2 and 4 of U.S. Pat. No. 4,125,990. In this case, the spool tubes disposed in the pockets block off the compartments themselves so that at first only empty spool tubes are filled into the pocket which, in an empty state, is applied to the compartment of the magazine which is farthest away. In this case, detector D and counter B would be sufficient.

The tube loading stations 18, 20, by means of a holding angle 29, are each arranged on the headstock 2, 3 of the spinning machine in such a manner that they can be detached and moved away as a whole. Expediently, they are locked together with the respective headstock 2, 3 during the operation by way of schematically depicted latches 29A which are selectively lockably engageable in the frame for the respective headstock 2, 3.

Figure 2A:
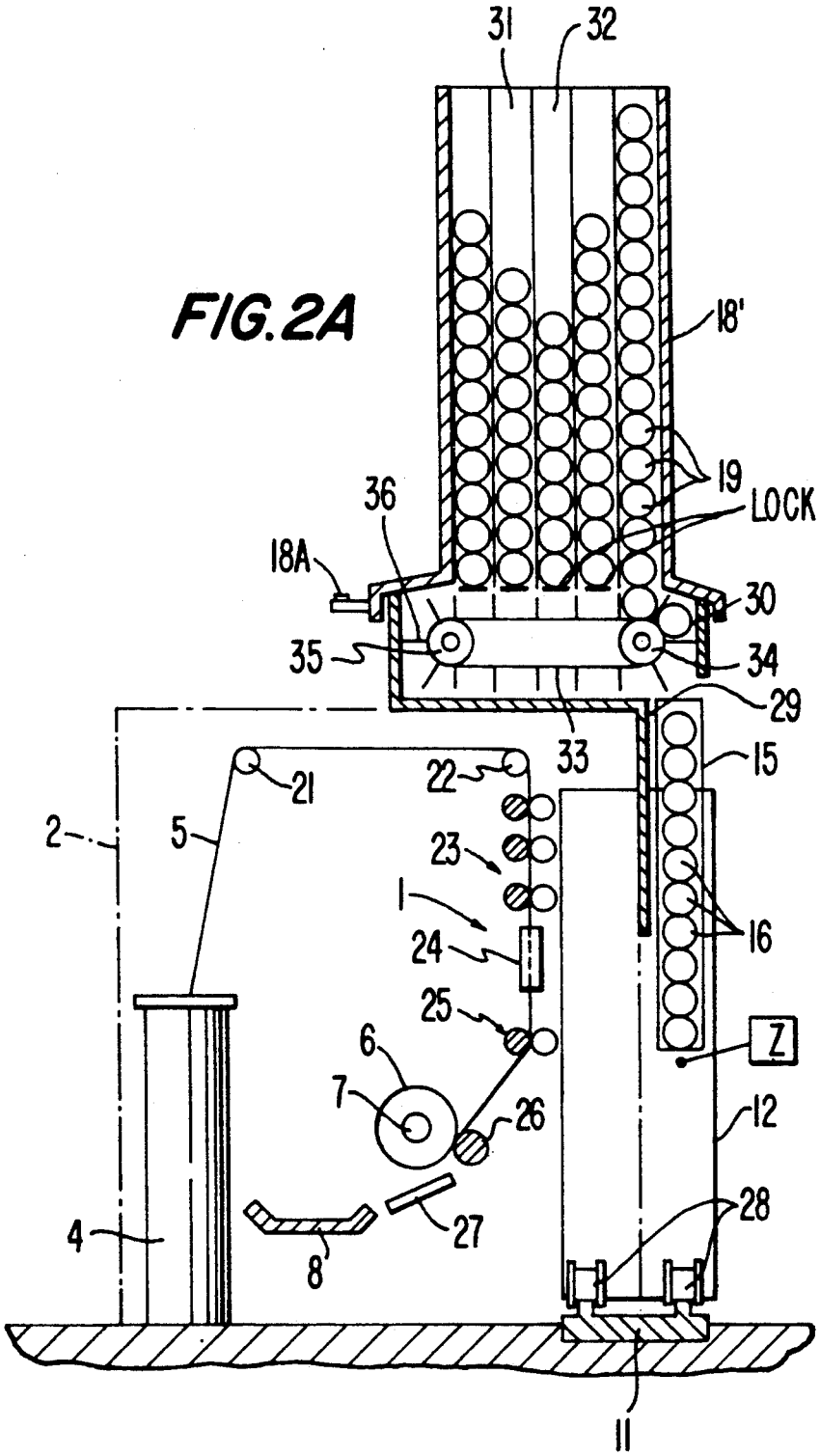
FIG. 2A is a partial schematic view similar to FIG. 2, showing a modified embodiment of the invention.

As a modification of the shown embodiment of FIG. 2, it is provided according to the embodiment of FIG. 2A (shown without the control system depicted from FIG. 2 for ease of illustration) that only the portion of the tube loading stations 18, which contains the vertical compartments 31, 32 is a detachable component. Detachable latches 18A are schematically depicted in FIG. 2A to illustrate this modification. This detachable portion component 18' will then, in the area of each of the vertical compartments 31, 32, be equipped with a floor element which can be moved away.

Figure 1A:
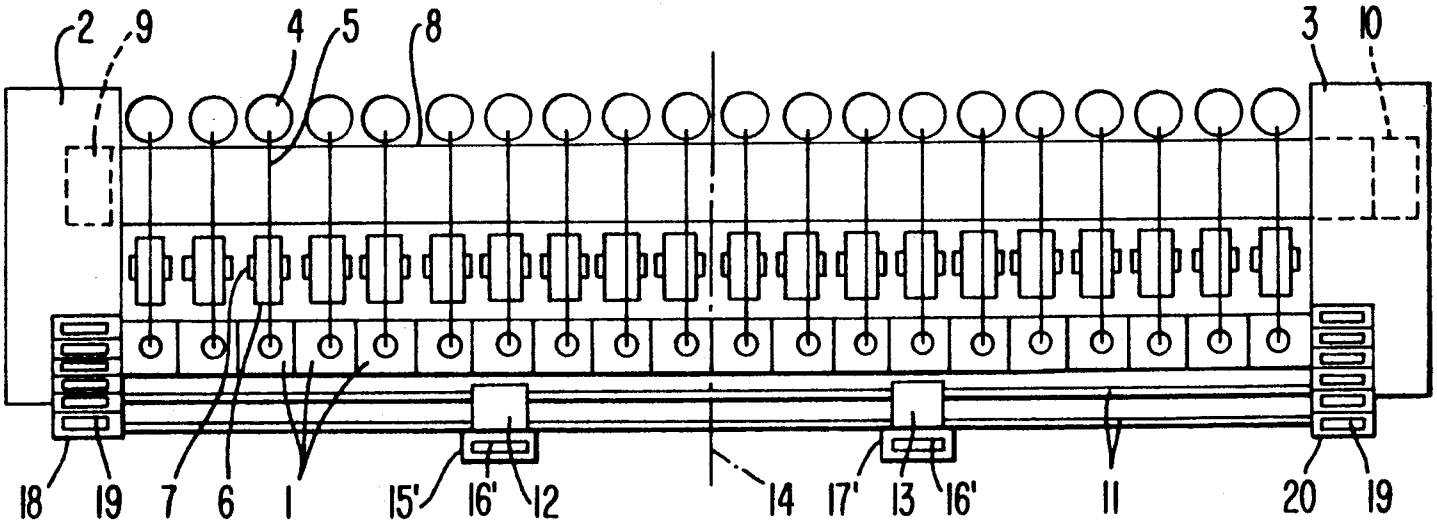
FIG. 1A is a view similar to FIG. 1 showing a modified embodiment of the present invention.

As shown in FIG. 1, the spool and package changing devices 12, 13, are constructed in a mirror-symmetrical manner with respect to their magazines 15, 17. As a modification of the shown embodiment, it is provided according to the embodiment of FIG. 1A that the spool and package changing devices 12', 13' are constructed identically; i.e., that also the magazines 15', 17' having spools 16' at the two spool and package changing devices are located in the same position, for example, at the side of the spool and package changing devices 12', 13' which is opposite the spinning units 1.

The tubes are normally conveyed in sheet-metal containers. In order to carry out an automatic transfer of the sheet-metal containers into the tube loading stations, it is provided in an embodiment of the invention, which is not shown, that devices are provided in the area of the tube loading stations 18, 20, for the emptying of a tube conveying container of this type and for transferring the tubes 19 to the tube loading stations 18, 20. For example, a receiving device may be provided at the rear side of the machine into which the tube conveying containers are pushed. The devices for the emptying of the tube conveying containers may be constructed as a belt lift which takes the tubes 19 out of the tube conveying container and transfers them into the vertical compartments 31, 32. In a different embodiment, it is provided that a lifting and tilting device is provided for tube conveying containers of this type which, in each case, grips one tube conveying container, lifts it up and fills the vertical compartments directly from this tube conveying container. In this case, a chute-type distributing device may also be provided which carries out the distribution into the individual vertical compartments.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Spool and package exchange apparatus for a spinning machine having a plurality of spinning units arranged adjacent one another at one side of a spinning machine in between headstocks arranged at respective opposite machine ends, which headstocks accommodate driving means for driving all of the spinning units of the spinning machine, said apparatus comprising:

two separate spool tube loading stations disposable at said one side of a spinning machine, and two movable spool tube exchanging devices disposable at said one side of a spinning machine, said spool tube exchanging devices each containing a magazine for accepting a plurality of empty spool tubes from a respective one of said spool tube loading stations, said spool tube exchanging devices including devices for ejecting wound packages at individual spinning units and exchanging empty spool tubes therefor, wherein said spool tube exchanging devices are disposed for movement only over respective different portions of the length of the one side of a spinning machine so as to operate substantially independently of the other of the spool tube exchanging devices with respective separate spool tube loading stations.

2. Apparatus according to claim 1, wherein the tube loading stations are each arranged at a respective machine end.

3. Apparatus according to claim 2, wherein the tube loading stations are arranged spatially above a magazine of the respective spool and package changing device.

4. Apparatus according to claim 2, comprising detachable connection structure for accommodating selective moving of the tube loading stations away from the machine.

5. Apparatus according to claim 2, comprising detachable connection structure for accommodating separation of a tube magazine of the tube loading stations from a delivery device which is stationarily arranged at the machine.

6. Apparatus according to claim 1, wherein the tube loading stations are arranged spatially above a magazine of the respective spool and package changing device.

7. Apparatus according to claim 6, comprising detachable connection structure for accommodating selective moving of the tube loading stations away from the machine.

8. Apparatus according to claim 6, comprising detachable connection structure for accommodating separation of a tube magazine of the tube loading stations from a delivery device which is stationarily arranged at the machine.

9. Apparatus according to claim 1, comprising detachable connection structure for accommodating selective moving of the tube loading stations away from the machine.

10. Apparatus according to claim 9, wherein common tracks for both spool and package changing devices are placed along the row of spinning units.

11. Apparatus according to claim 1, comprising detachable connection structure for accommodating separation of a tube magazine of the tube loading stations from a delivery device which is stationarily arranged at the machine.

12. Apparatus according to claim 11, wherein common tracks for both spool and package changing devices are placed along the row of spinning units.

13. Apparatus according to claim 1, wherein common tracks for both spool and package changing devices are placed along the row of spinning units.

* * * * *